US007856862B2

(12) United States Patent
Sodini

(10) Patent No.: US 7,856,862 B2
(45) Date of Patent: Dec. 28, 2010

(54) DEVICE FOR CORRECTING DAMAGED VEHICLE BODY SHEETS

(76) Inventor: Dino Sodini, Via Pontestrada, 15/6, 54100 Massa (IT)

( * ) Notice: Subject to any disclaimer, the term of this patent is extended or adjusted under 35 U.S.C. 154(b) by 594 days.

(21) Appl. No.: 11/571,301

(22) PCT Filed: Nov. 15, 2005

(86) PCT No.: PCT/IB2005/003408

§ 371 (c)(1),
(2), (4) Date: Jan. 9, 2007

(87) PCT Pub. No.: WO2006/054141

PCT Pub. Date: May 26, 2006

(65) Prior Publication Data

US 2008/0093587 A1 Apr. 24, 2008

(30) Foreign Application Priority Data

Nov. 17, 2004 (EP) ..... 04425857

(51) Int. Cl.
*B21J 13/08* (2006.01)
*B21C 1/00* (2006.01)

(52) U.S. Cl. ..... 72/457; 72/454; 72/705

(58) Field of Classification Search ..... 72/705, 72/457, 453.01, 454, 411
See application file for complete search history.

(56) References Cited

U.S. PATENT DOCUMENTS 2,185,550 A * 1/1940 Gerdes ..... 72/392
3,149,660 A * 9/1964 Smith ..... 72/293
3,180,612 A 4/1965 Spyridakis et al.
3,201,968 A * 8/1965 Hill ..... 72/392
3,286,776 A 11/1966 Richison et al.

(Continued)

FOREIGN PATENT DOCUMENTS

FR 2644383 9/1990

(Continued)

*Primary Examiner*—Dana Ross
*Assistant Examiner*—Pradeep C Battula
(74) *Attorney, Agent, or Firm*—Dennison, Schultz & MacDonald

(57) ABSTRACT

The invention relates to a tool, suitable for body shops for correcting damaged vehicle body sheets, but also suitable for saving people trapped in a damaged vehicle and also for other applications that require opposite codirectional forces of high intensity with a rectilinear movement of a movable element, which is practical and independent from external energy sources. The tool (1) uses, as source of rotational movement, a common electric screwer (2) connected in a releasable way within the box (70) of said tool, with its driven shaft connected to a screw mechanism which supports in translational movement a movable element (10). The box of the tool has a front face (8) and a rear face (23), arranged at the lend of the side faces (29, 29') and the lower face kept together by the four screw pulling elements (28, 28') tightened by respective four nuts (25). On the front face (8) a fixed element (9) is connected, in which telescopically slides the movable element (17) operated by the screwer (2). The fixed element (9) and the movable element (10) have threads (16, 17) at respective distal lends, to allow assembling to said tool (1) elements interfacing to force application surfaces on the vehicle body. On the rear face (23) an screw threaded element (24) is provided for connection of said interface elements.

12 Claims, 7 Drawing Sheets

U.S. PATENT DOCUMENTS

| | | | | |
|---|---|---|---|---|
| 3,369,615 | A | 2/1968 | Maffey et al. | |
| 3,395,561 | A * | 8/1968 | Lague et al. | 72/308 |
| 4,052,652 | A | 10/1977 | Simnovec et al. | |
| 4,191,264 | A | 3/1980 | Antipov et al. | |
| 4,586,230 | A * | 5/1986 | Harydzak et al. | 29/254 |
| 4,736,927 | A * | 4/1988 | Clancy | 254/93 R |
| 5,544,862 | A * | 8/1996 | Hickerson | 254/124 |
| 6,039,126 | A | 3/2000 | Hsieh | |
| 6,218,746 | B1 | 4/2001 | Gouge | |
| 6,244,568 | B1 * | 6/2001 | Patton | 254/93 R |
| 6,612,144 | B2 * | 9/2003 | Domino | 72/67 |
| 6,679,092 | B2 * | 1/2004 | Irii | 72/457 |
| 2002/0104365 | A1 | 8/2002 | Irii | |
| 2003/0214089 | A1 | 11/2003 | Duncan | |

FOREIGN PATENT DOCUMENTS

| | | |
|---|---|---|
| GB | 931193 | 7/1963 |

* cited by examiner

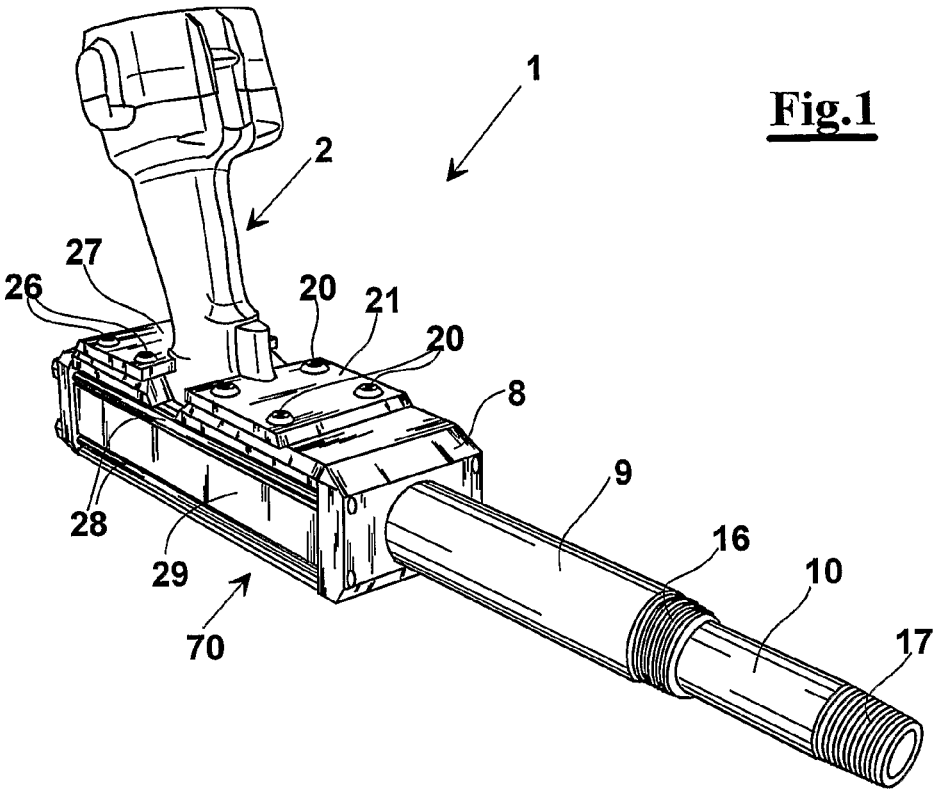
Fig.1
Fig.2
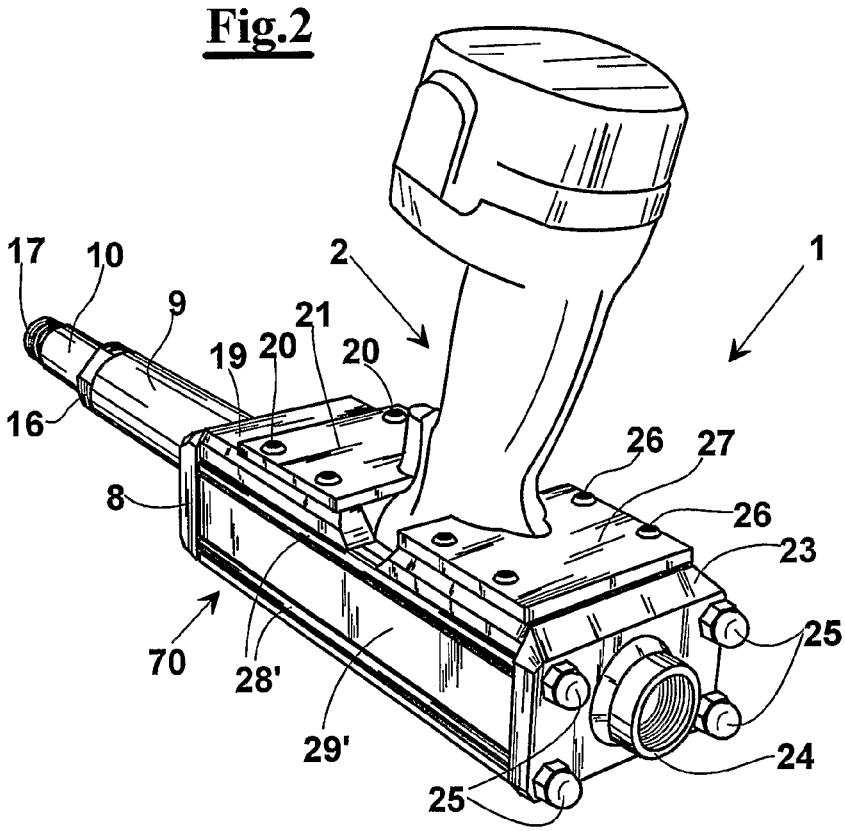

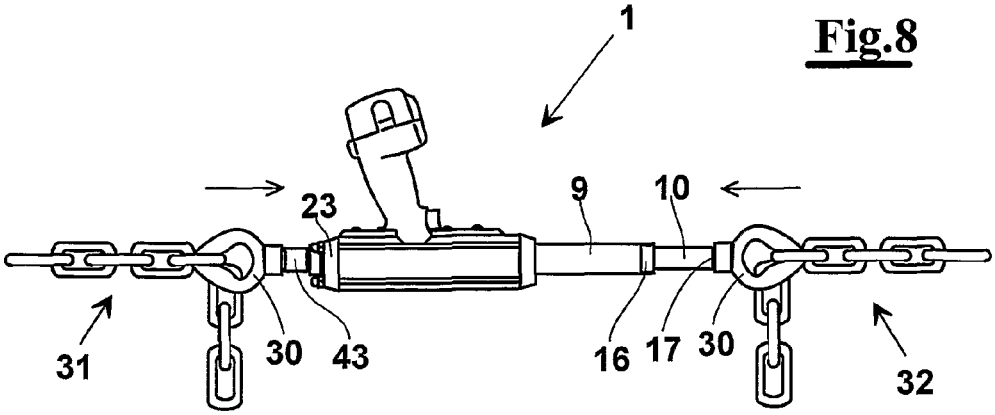
Fig.8
Fig.9
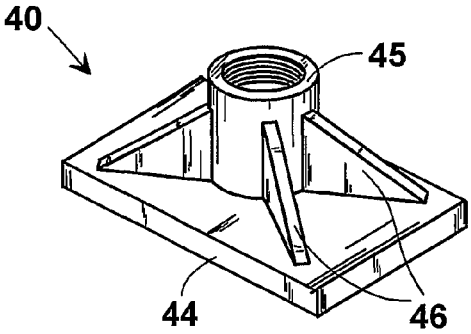
Fig.10
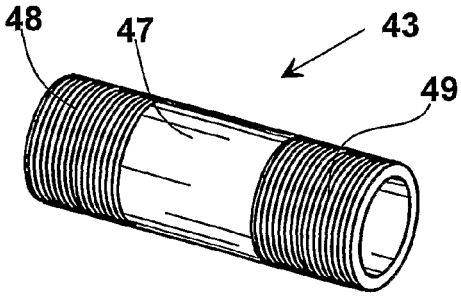
Fig.11
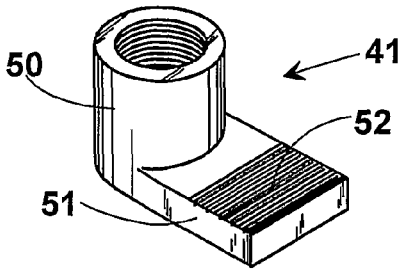

DEVICE FOR CORRECTING DAMAGED VEHICLE BODY SHEETS

FIELD OF THE INVENTION

The present invention relates to an equipment for generation of opposite strong co-directional forces which is practical to use and independent from external energy sources, such as in particular for correcting damaged vehicle body sheets in body shops, but also in case of assistance to accidents to extract people from a damaged vehicle.

DESCRIPTION OF THE PRIOR ART

Many devices are known which have attempted to solve the technical problem of providing two opposite pushing or pulling forces of high intensity.

In particular devices exist, conventionally used for straightening sheet portions of a damaged car, comprising a hydraulic or pneumatic cylinder capable of extending its length when it is fed with a pressurized fluid.

In particular, among the known devices, a portable actuator exists with a hydraulic cylinder, fed by a manually operated hydraulic piston pump and connected to the hydraulic cylinder by a high pressure duct. This device, having the hydraulic piston pump separated from the linear actuator, has the drawback of requiring at least two operators, one for positioning and keeping operatively in position the actuator and one for operating the hydraulic piston pump.

Hydraulic piston devices exist, furthermore, which can be operated by a hydraulic control unit, but have the drawback of being not portable and then not much practical when a damaged vehicle cannot be easily transported to a working position.

Other devices exist that provide a pulling arm with a pulling screw operated by a pneumatic rotational motor which can be fixed to a vehicle repair bench. In particular, WO9423859 describes an apparatus comprising a first support table sliding on an edge of the repair bench, a second table connected to the first table and rotatable about a horizontal axis, and a pulling arm pivotally connected to the second table in order to operate in a workspace located above or below the working bench. This system, being connected to the working bench, has the limitation of being not portable and it must be used only in the body shop.

Another device exists, described in EP1228821, for correcting vehicle body sheets, which obtains a linear movement and two opposite forces using a pneumatic motor like that of WO9423859. The motor causes a screw shaft to rotate, which engages in a nut screw movable in an axial direction but not free to rotate, thus causing said nut screw to move in a rectilinear direction, integral to an end element of said tool. The system is operated by closing the compressed air circuit by a opening/closing valve arranged in a handgrip of the actuator. This type of actuator is much lighter than the previous and requires a single operator, but has the drawback of requiring a source of compressed air that can be supplied by a portable compressor or by a fixed plant of compressed air provided in the body shop.

The device of EP1228821, for this reason, cannot be used, where the damaged car is still in the place of the accident, when a particular urgency of operation is required, for example for freeing people trapped in a damaged vehicle, unless a portable a compressor is brought along with it.

Electric devices are also known as described in U.S. Pat. No. 6,039,126, that are multipurpose and suitable for providing a torque for operating instruments of many kinds, for example a screw-type jack. However, they are not suitable for correcting the metal deformed sheets owing to the high starting torque necessary. Furthermore, they are not capable of providing both a torque for a pulling action and a torque for a pushing action.

SUMMARY OF THE INVENTION

It is, then, a feature of the present invention to provide a tool capable of correcting damaged vehicle body sheets simply pushing or pulling the sheets, which is light, of small size as well as quick and easy to use.

Another object is to provide such a tool that does not require, in use, a source of pressurized fluid so that an air compressor or a hydraulic control unit or other devices for providing such fluid are not necessary.

Another feature of the present invention is to provide such a tool, which can use a source of energy accumulated in the tool, thus resulting operatively independent from supply means when in use.

A further feature of the present invention is that this tool can be used by a body shop worker who at the same time can both arrange an end of the tool onto a sheet to straighten and feed forward/backwards the end of the tool, obtaining a simplification of the work.

Another feature of the present invention is that the tool has a solid structure in order to bear high operative loads even if maintaining a compact and light structure.

Another feature of the present invention is that this tool is easily used in case of emergency on the place of an accident to help people trapped in a damaged vehicle and for all other applications that require opposite co-directional forces of high intensity, with high practicality and independence from external energy sources.

It is, also, a feature of the invention to provide a tool that is capable of bearing high loads both in traction and in compression starting from a still position and proceeding with a succession of stepped movements.

These and other objects are obtained, according to the present invention, by a tool to generate opposite and co-directional forces of high intensity, comprising:

- a box with a front face and a rear face, suitable for bearing strong pulling or pushing loads between said faces;
- a linear actuator having a fixed element integral to said box and at least one movable element capable of being guided in said fixed element in order to withdraw or extend telescopically with respect to said fixed element, said movable element protruding from said fixed element at said front face;

characterised in that it comprises:

- an electric motor capable of providing a rotational movement;
- means for transmitting the movement of said electric motor to said movable element suitable for transforming the rotational movement of said electric motor into a translational movement of said movable element;
- an impact device integrated in said means for transmitting, suitable for providing a plurality of impact actions to said movable element for overcoming blocked situations, and wherein said box acts as force bearing element between said front face and said rear face, forces being applied through said movable element and said rear face.

This way, said tool is capable of providing two coaxial and opposite pushing/pulling forces, generated by said electric motor, through the linear movement of said movable element respectively towards the inside and the outside of said box.

In a possible exemplary embodiment said electric motor is contained in an electric screwer of known type releasably mounted in said box, so that said screwer engages said means for transmitting.

In an advantageous exemplary embodiment, said linear actuator comprises a fixed element, mounted on said front face of said box, and a movable element sliding inside.

Advantageously, said rear face and said movable element comprise means for coupling with said pulling, pushing or hooking interfaces for the surfaces on which said forces have to be applied.

Advantageously, said rear face of said box comprises a rear fastening element that remains out of said box and opposite to said first fixed element, suitable for supporting pulling, pushing or hooking interfaces for the surfaces on which said forces have to be applied.

In particular, said means for coupling with said pulling, pushing or hooking interfaces for the surfaces on which said forces have to be applied comprise screw threaded nipples on said rear fastening element or on said movable element.

Advantageously, said box is reinforced by pulling elements locked between said rear and front faces.

In particular said pulling, pushing or hooking interfaces are selected from the group:

- a plate for applying pushing forces towards outside;
- an elongated element arranged in a plane perpendicular to the axis of said transmitting means for applying either pushing or pulling forces;
- a hook or eyelet for applying pulling forces with tendons or chains.

Advantageously, said means for transforming the rotational movement of said electric motor into a translational movement comprise a screw mechanism, where a screw is integral to the motor shaft and a nut screw is integral to said movable element.

Preferably, said box consists of a single piece (obtained by casting or welding) or of metal parts mounted in order to bear high transmission forces between said rear and front faces, fixed by pulling screws arranged between said front face and said rear face.

Advantageously, said box comprises closure members suitable for releasably blocking said electric motor at said screw integral to the shaft of the motor.

Preferably, said box is integral to a handgrip for allowing an easy use.

Advantageously, said electric motor is energised by a electric battery integral to said tool, said tool being thus independent from external energy sources and then easily portable.

Then, said tool can be used for example in body shops for correcting the deformation of the damaged sheets of a vehicle, has a compact and reduced size, is easily portable, is independent from a source of external energy owing to a rechargeable battery for example associated to the handgrip as a known screwer, and can be used by a single operator for generating two opposite pulling and pushing forces of high intensity.

In addition to a use in a body shop, it is suitable for use in places different from a body shop, such as, for example in case of emergency or first aid to people trapped in damaged vehicles or in all applications where high forces are requires in small spaces, with practicality of use also in absence of external energy sources.

In particular, said impact device integrated in said transmission means comprises an impact element capable of applying a plurality of tangential impacts to said shaft of said motor when the torque demand exceeds a predetermined value.

BRIEF DESCRIPTION OF THE DRAWINGS

The invention will be made clearer with the following description of an exemplary embodiment thereof, exemplifying but not limitative, with reference to the attached drawings wherein:

FIGS. 1 and 2 show two perspective views, respectively front and rear views, of the tool according to the invention;

FIGS. 5, 6, 7 and 8 side views of four different combinations of pulling, pushing or hooking interfaces assembled between the tool according to the invention and the surfaces on which said forces have to be applied;

FIGS. 9, 10 and 11 show some examples of interfaces between the tool according to the invention and the surfaces on which said forces have to be applied;

DESCRIPTION OF A PREFERRED EXEMPLARY EMBODIMENTS

Figure 3:
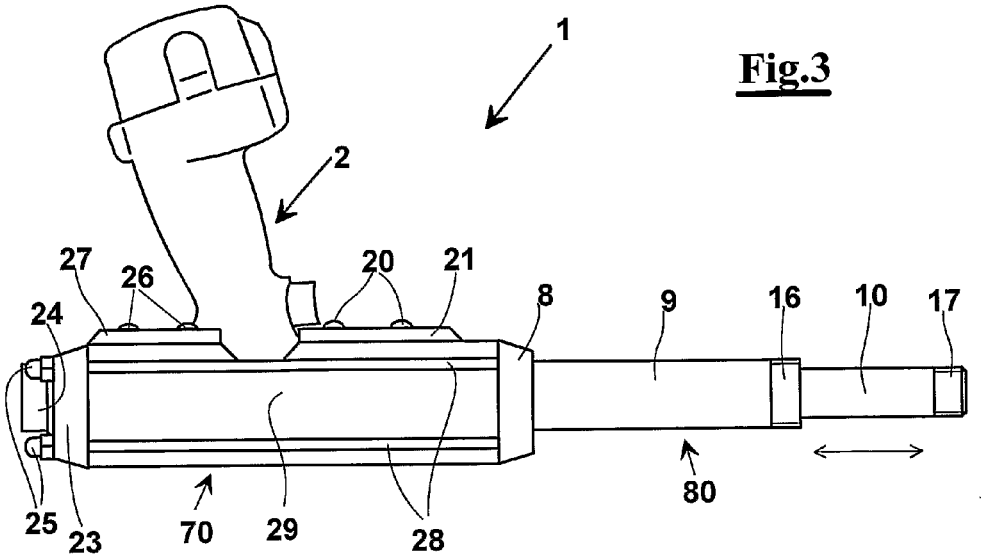
FIG. 3 shows an elevational side view of the tool according to the invention.

The present invention relates to a tool to obtain two opposite forces of high intensity and at the same time a rectilinear movement of a movable element.

In FIGS. 1 and 2 a perspective view is shown of an exemplary embodiment of said tool 1, suitable for use in body shops for correcting the deformation of damaged sheets of a vehicle, but suitable also out of a body shop, such as, for example, for freeing people trapped in damaged vehicles or in all the applications where high forces are required in small spaces, with practicality of use also in absence of external energy sources.

In particular FIG. 1 shows tool 1 according to the invention in a perspective front view, whereas FIG. 2 shows a rear view of the tool 1.

Tool 1 uses, as source of rotational movement, a screwer 2 of known type on the market connected, in a releasable way within a box 70 of said tool, with the driven shaft connected to a screw mechanism, not shown in the figure, which transmits a translational movement to movable element 10. The box of the tool has parallelepiped hollow shape and has a front face 8 and a rear face 23, arranged at the end of the side faces 29, 29' and the lower face, kept together by the action of the four screw threaded pulling elements 28 and 28' along with the respective four nuts 25. The above described box 70 has an upper aperture allowing the introduction of screwer 2, and a closure thereof formed by plates 21 and 27 fastened to the box by screws 20 and 26 respectively.

Since the above described box 70 has the function of transmitting forces of high intensity between front face 8 and rear face 23, it is built to be very solid and strong in order to bear pushing or pulling forces applied to the above described front and rear faces.

On front face 8 a fixed element 9 is connected, in which telescopically slides movable element 10 operated by screwer 2.

Fixed element 9 and movable element 10 have respective threads 16 and 17 at the respective distal ends, to allow assembling interface elements of said tool 1 and force application surfaces.

On rear face 23 a screw threaded fastening element 24 is connected also to allow assembling interface elements.

FIG. 3 shows a side view of tool 1 according to the invention, comprising a box 70, a linear actuator 80 and a screwer 2. Screwer 2 is arranged within box 70 that comprises a front face 8, a rear face 23, three side elements of which that indicated as 29 is visible. The elements that form the box are kept together by four pulling elements, two of which are shown indicated as 28. The box remains open at one side for putting the screwer in, which can be blocked by means of two plates 27 and 21, connected to box 70 with respective screws 26 and 20.

The box is connected on front face 8 to linear actuator 80, and on rear face 23 to fastening element 24, which is screw threaded at the distal end in order to connect the interface elements with the surfaces on which said forces have to be applied.

Figure 4:
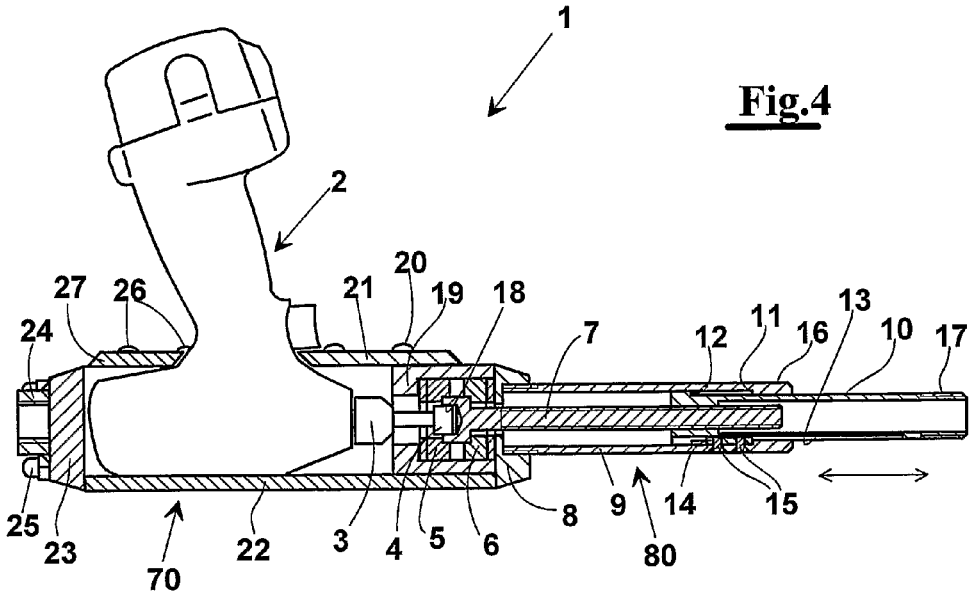
FIG. 4 shows a cross sectional view of the tool, obtained along a longitudinal plane passing through the axis of the linear actuator.

In FIG. 4 a longitudinal cross section of the tool showing the inner structure of the device is shown. The screwer has an output member 3 that causes a driven shaft 4 to rotate that is arranged in a housing 18, comprising bearings 5, 6, at an end of a screw threaded element 7. Screw threaded element 7 engages in a threaded seat at an end of movable element 10, thus creating a screw mechanism. Movable element 10 is free of sliding in fixed element 9, which has a threaded front face 8. The end housing 18 of screw threaded element 7, is held in a support 19 by means of two opposite conic bearings. A rectilinear movement of the movable element stops at the maximum extension, owing to the contact of two abutment surfaces 12 and 16 respectively of the movable element and of fixed element 9 of actuator 80. Movable element 10 can move only along its axis but cannot rotate since the rotation is blocked by a tang 14 provided in fixed element 9 and sliding in a channel 13 executed outside along a straight line of movable element 13. Tang 14 is connected to fixed element by screws 15.

The rear face of the box comprises a screw threaded element 24 co-axial to linear actuator, suitable for supporting an element of interface with the surfaces on which said forces have to be applied. For the same object threads 16 and 17 are provided respectively on fixed element 9 and on movable element 10.

In the previous figures an electric motor is shown that is integrated in a screwer. This does not exclude that a dedicated motor is made and housed in the box, with handgrip integral to the box.

Figures from 5 to 8 show different modes of use of tool 1 for pulling or pushing actions.

Figure 5:
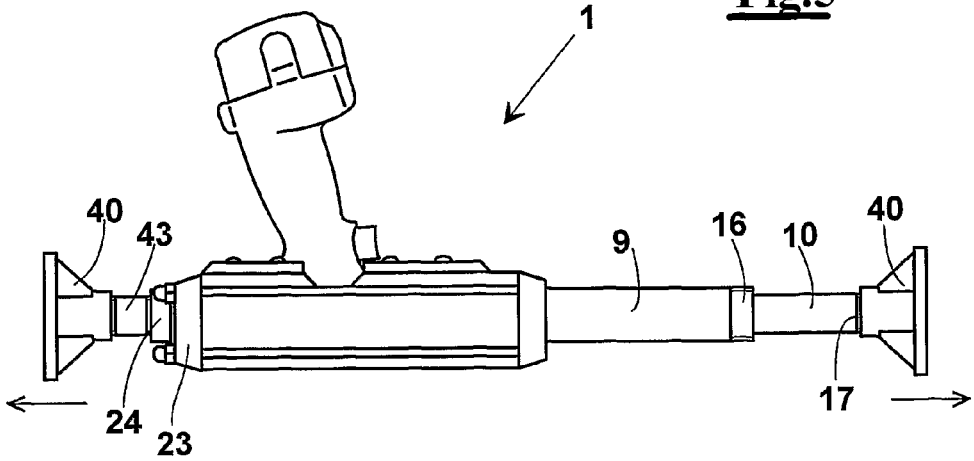

In particular, in FIG. 5, the tool applies two opposite pushing actions by two plates 40, of which one is mounted at rear face 23, by the threaded sleeve 43, and the other is mounted at the end of movable element 10.

Figure 6:
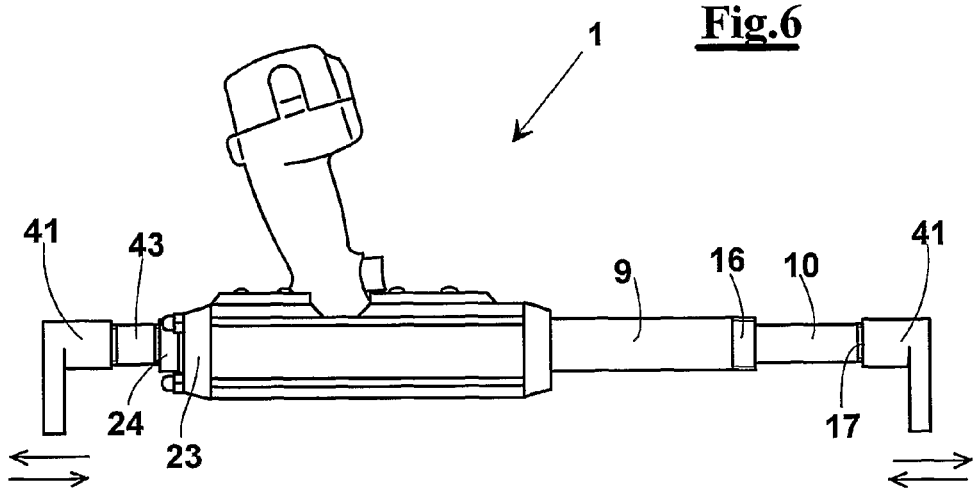

In FIG. 6 an use of the tool is shown for said forces to be applied for pulling or pushing actions between surfaces located at a distance comparable to the length of the tool. In this case interface elements 41 are used that have two operating surfaces in order to be used both for pulling or pushing actions. Even in this case interface element 41 located at rear face 23 is mounted by the threaded sleeve 43.

Figure 7:
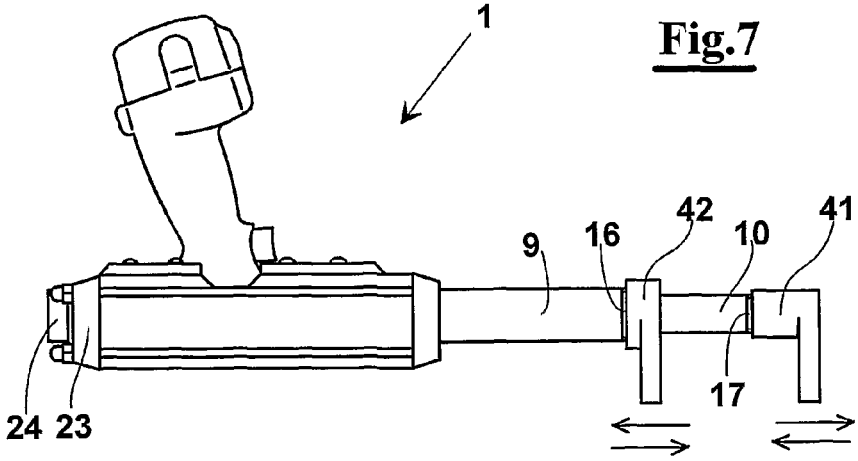

FIG. 7 shows a case of use of the tool for said forces have to be applied of traction or compression between surfaces approached to each other. In this case is used an element 41 mounted at the end of movable element 10 and an element 42 connected to fixed element 9.

In FIG. 8 a use of the tool is shown for applying two forces pulling two chains. In this case eyelet interface elements of known art are used.

Obviously, the ways of mounting the shown interface elements are only examples of use, but are not limitative because can be change at the choice of the user.

FIGS. 9, 10, 11 show three different types of interface elements. In particular in FIG. 9 an element of compression 40 is shown comprising a plate 44, a threaded sleeve 45 and stiffening wings 46. In FIG. 10 a threaded sleeve 43 is shown. In FIG. 11 an element of interface 41 is shown suitable for being used both in compression and in traction, comprising a plate-shaped portion 51 having a knurled 52 surface on both the faces for increasing the friction with the surfaces on which said forces have to be applied.

Figure 12:
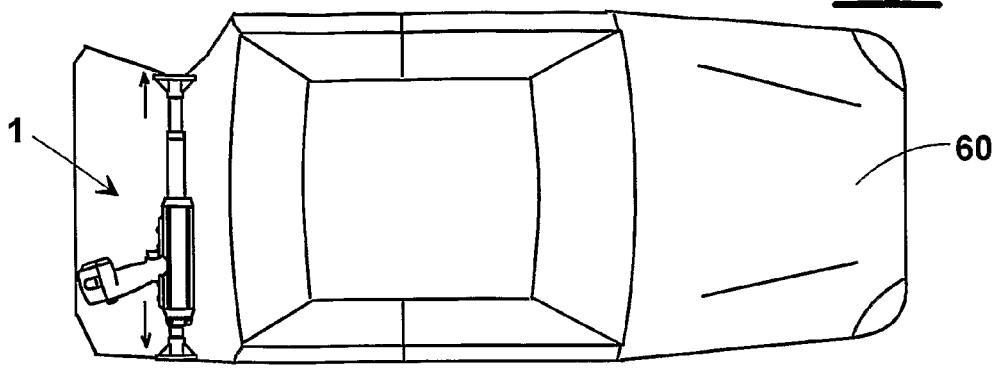
FIG. 12 shows an example of use of the tool according to the invention in case of correction of the deformation of a vehicle body sheet.

Figures from 12 to 14 show the application of tool 1 in different fields and different cases. In particular in FIG. 12 an example is shown where tool 1 is used in a body shop for correcting the deformed sheets of a damaged car simply pushing the above described surfaces.

Figure 13:
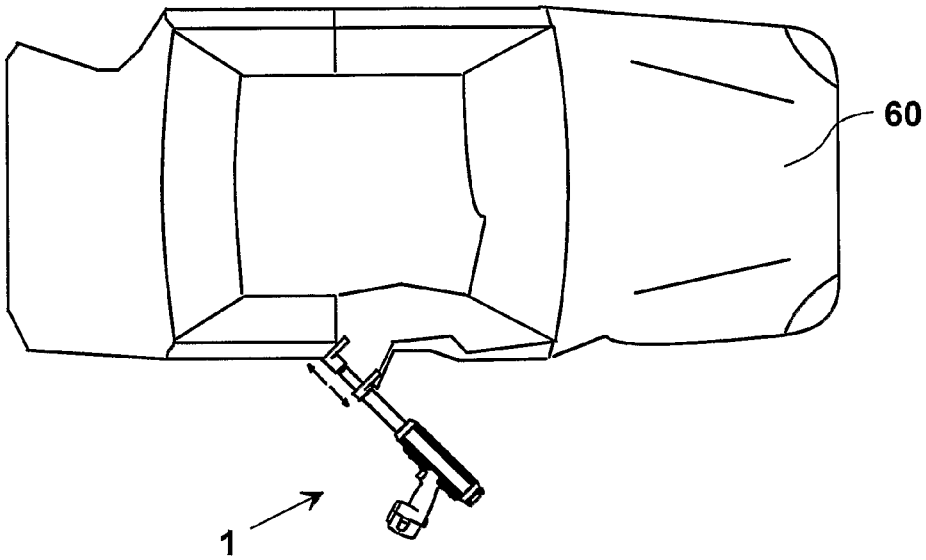
FIG. 13 shows an application of the tool for freeing people trapped in a damaged car.

In FIG. 13 tool 1 is used for freeing people trapped in a damaged car.

Figure 14:
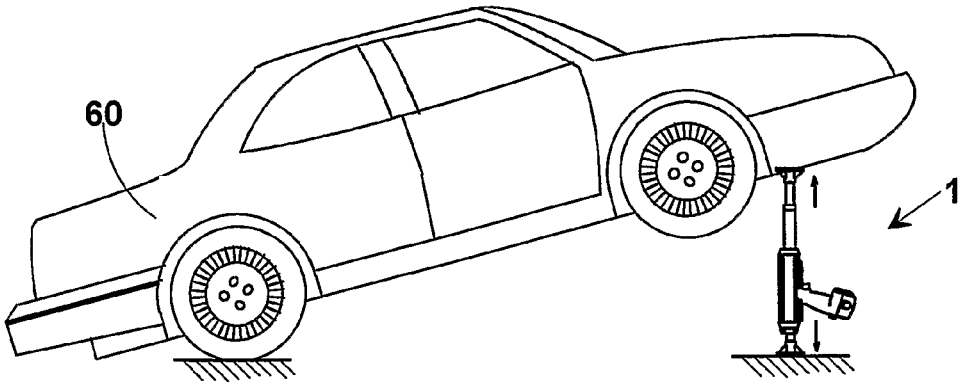
FIG. 14 shows, alternatively, the use of the tool for raising a car.

In FIG. 14, tool 1 is used for raising a car, owing to the high force obtainable, in some cases about of 8000N.

Then, said tool is capable of correcting the deformation of damaged sheets of a vehicle, is compact, of limited size, is easily portable, is independent from a source of external energy owing to a rechargeable battery that can be associated to a screwer, can be used by a single operator and is capable to obtain two opposite pulling and pushing forces of high intensity.

Figure 15:
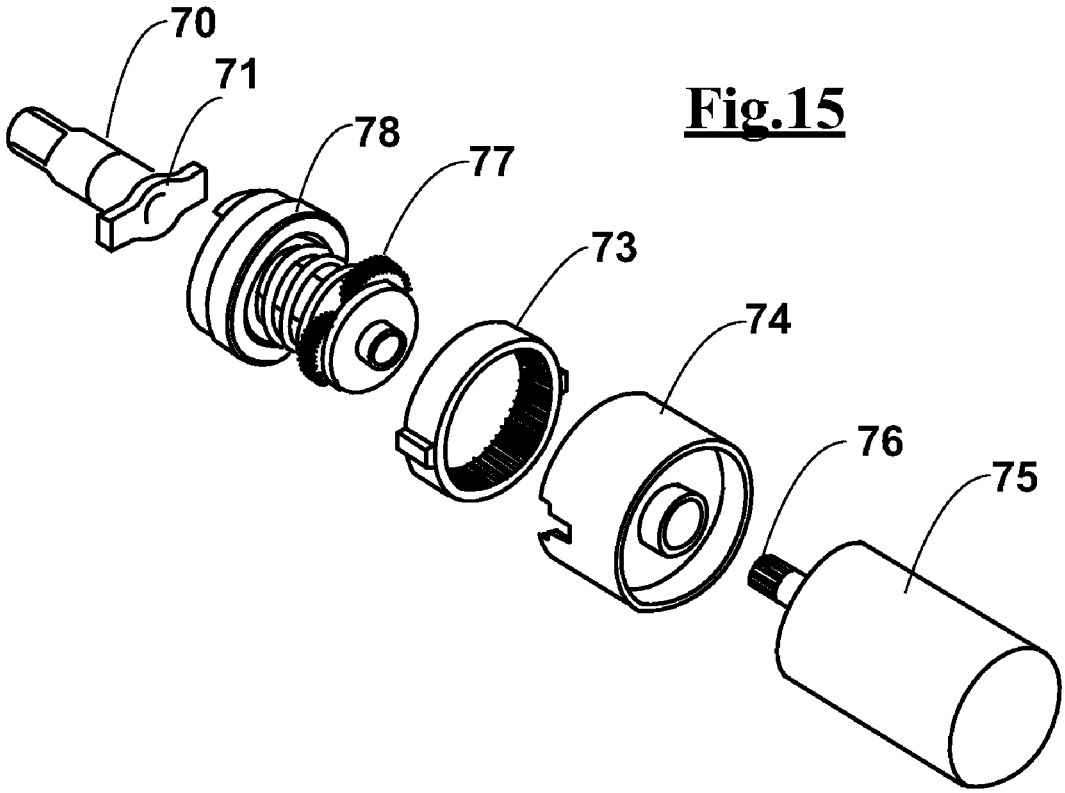
FIG. 15 shows an exploded view of a possible known transmission means of the movement between an electric motor and a shaft, having an impact device.

FIG. 15 shows an example of known transmission means of the movement between an electric motor 75 and an output shaft 70, that can be arranged in a position like that of box 18 of FIG. 4. The transmission means comprises an impact device 71 having an impact element 72. The electric motor 75, which can be the motor of screwer 2, has a splined shaft 76 that meshes a reduction epicyclical gear mechanism 77 comprising three gears via an inner fixed crown gear 73 on a ring 74. The three gears 77 are pivotally connected to a base 78 that causes impact element 72 to rotate, which applies a plurality of tangential impacts on portions 71 protruding from output shaft 70.

Figure 16:
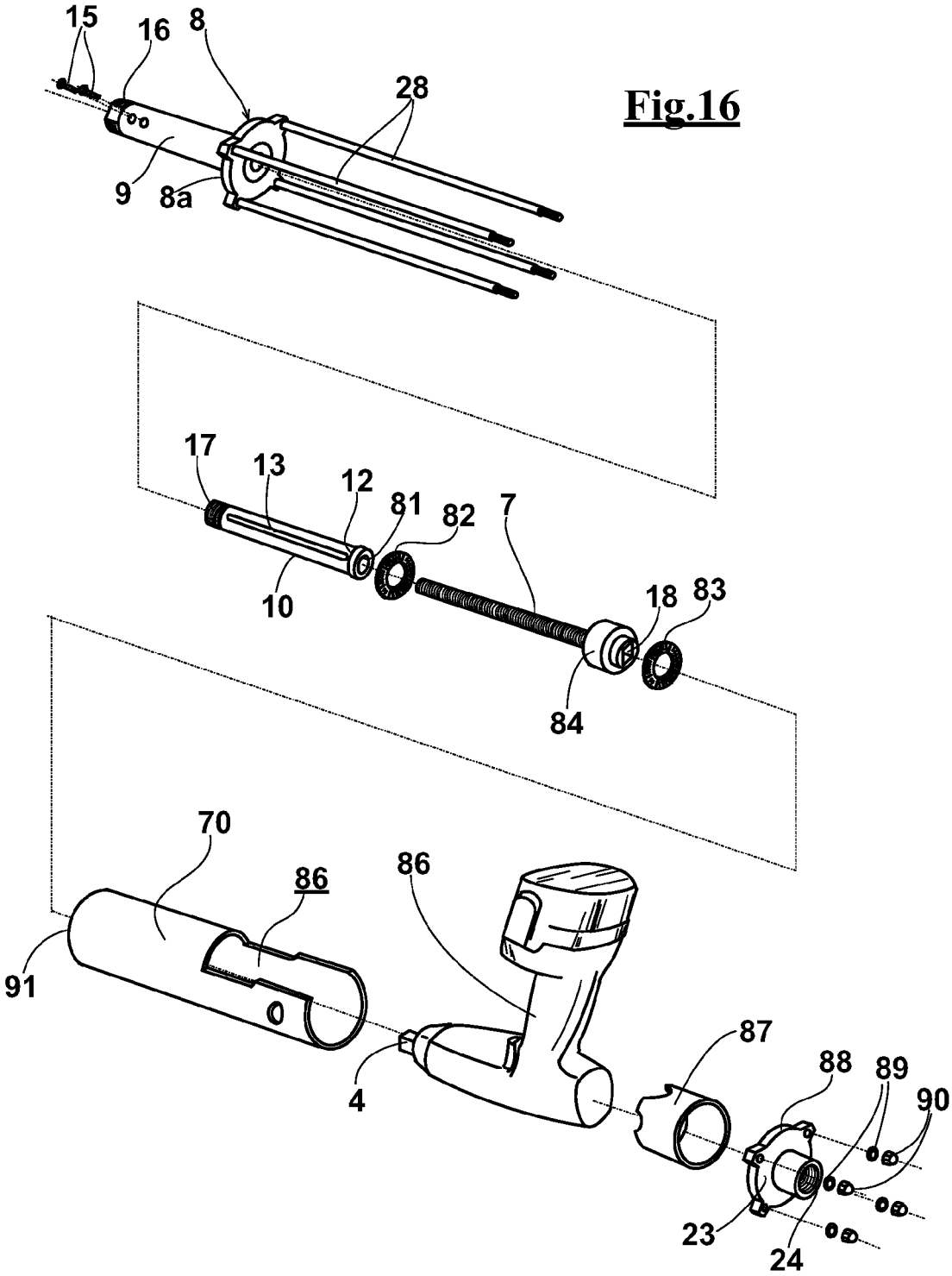
FIG. 16 shows an exploded view of a preferred exemplary embodiment of a device according to the invention.

FIG. 16 shows the exploded view of a preferred exemplary embodiment of a device according to the invention having a fixed cylindrical element 9 in which a movable element 10 axially slides operated by a screw threaded element 7 pivotally engaged in a screw threaded hole 81 co-axial to movable element 10. The screw threaded element has at one end a housing 18 with square cross section suitable for housing a shaft 4 with square cross section of an electric screwdriver 2 mounted coaxial to the screw threaded element, so that the electric screwdriver can transmit the torque to screw threaded element 7. In particular, screwdriver 2 comprises a system of transmission of the movement to the impact device, not shown, suitable for providing a plurality of tangential pulses to the shaft 4 when a high torque is demanded. Fixed element 9 is co-axial and integral to a front plate 8 having a front face 8A. Front plate 8 comprises a plurality, four in particular, of pulling pull elements 28 suitable for pulling a rear plate 23. Movable element 10 for a large portion of its length has a longitudinal channel 13 in which with two blocking screws 15 engage put in respective holes of fixed element 9. Furthermore, a limit stop to a maximum extension of the movable element is determined by an abutment surface 12 provided at one end of the movable element 10. This way, at a maximum extension surface 12 abuts with a corresponding inner abutment surface not shown, which is provided at one end of fixed element 16. Screw threaded element 7 has an enlarged end 84 that engages between front plate 8 and a housing not shown on a front face 91 of a box 85, suitable for containing the above described screwdriver 2. This screwdriver 2 is blocked in box 85 by a locking ring 87, shaped in order to block screwdriver 2 within box 85 in a correct position. Box 85 is, moreover, closed by a rear plate 88 having a rear face 23 facing outwards and having an interface screw threaded element 24. This plate has a plurality of through holes suitable for causing the corresponding pulling elements 28 to pass, in order to block plate 23 by nuts 90 and washers 89.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. A tool to generate opposite and co-directional forces of high intensity, comprising:

a box with a front face and a rear face, suitable for bearing strong pulling or pushing loads between said faces;

a linear actuator having a fixed element integral to said box and at least one movable element capable of being guided in said fixed element in order to withdraw or extend telescopically with respect to said fixed element, said movable element protruding from said fixed element at said front face;

an electric motor capable of providing a rotational movement;

means for transmitting the movement of said electric motor to said movable element suitable for transforming the rotational movement of said electric motor into a translational movement of said movable element;

an impact device integrated in said means for transmission, suitable for providing a plurality of impact actions to said movable element for overcoming blocked situations;

wherein said box acts as force bearing element between said front face and said rear face, forces being applied through said movable element and said rear face; and wherein said means for transforming the rotational movement of said electric motor into a translational movement comprises a screw mechanism, comprising a screw that is integral with the motor shaft and a nut screw that is integral with said movable element.

2. A tool, according to claim 1, wherein said electric motor is contained in an electric screwer of known type releasably mounted in said box.

3. A tool, according to claim 1, wherein said fixed element of said linear actuator is mounted on said front face of said box.

4. A tool, according to claim 1, wherein said rear face and said movable element comprise respective means for coupling with pulling, pushing or hooking interfaces acting on surfaces on which forces are applied, said means for coupling at said rear face and said movable element being suitable for transmitting forces on a same axis.

5. A tool, according to claim 4, wherein said means for coupling comprise screw threaded nipples on said rear fastening element or on said movable element.

6. A tool, according to claim 4, wherein said pulling, pushing or hooking interfaces are selected from the group consisting of:

a plate for applying pushing forces towards outside;

an elongated element arranged in a plane perpendicular to the axis of said transmitting means for applying either pushing or pulling forces; and a hook or eyelet for applying pulling forces with tendons or chains.

7. A tool, according to claim 1, wherein said box is reinforced by pulling elements which are tightened between said rear and front faces.

8. A tool, according to claim 1, wherein said box is a single piece, obtained by casting or welding, or is formed from metal parts mounted in order to bear high transmission forces between said rear and front faces, fixed by pulling screws tightened between said front face and said rear face.

9. A tool, according to claim 1, wherein said box comprises closure members suitable for releasably blocking said electric motor in said box.

10. A tool, according to claim 1, wherein said box is integral with a handgrip for allowing easy use.

11. A tool, according to claim 1, wherein said electric motor is energised by an electric battery integral with said tool.

12. A tool, according to claim 1, wherein said impact device integrated in said transmission means comprises an impact element capable of applying a plurality of tangential impacts to said shaft of said motor when the torque demand exceeds a predetermined value.

* * * * *